US006244940B1

(12) United States Patent
Boulton et al.

(10) Patent No.: US 6,244,940 B1
(45) **Date of Patent: *Jun. 12, 2001**

(54) BLASTING DEVICE FOR CLEANING A WALL

(75) Inventors: George F. Ch. Boulton, Scunthorpe (GB); Adrianus G. van Houten, Maarsen (NL)

(73) Assignee: E.B.E. Nederland B.V. (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/981,194

(22) PCT Filed: Jun. 14, 1996

(86) PCT No.: PCT/NL96/00243

§ 371 Date: Mar. 17, 1998

§ 102(e) Date: Mar. 17, 1998

(87) PCT Pub. No.: WO97/00156

PCT Pub. Date: Jan. 3, 1997

(30) Foreign Application Priority Data

Jun. 15, 1995 (NL) ..... 1000576

(51) Int. Cl.[7] ..... B24C 5/00

(52) U.S. Cl. ..... 451/95; 451/97; 451/88; 451/89

(58) Field of Search ..... 451/87, 88, 89, 451/92, 94, 95, 97

(56) References Cited

U.S. PATENT DOCUMENTS

| | | | | |
|---|---|---|---|---|
| 3,436,866 | * | 4/1969 | Nye | 451/92 |
| 3,566,543 | | 3/1971 | Fogle . | |
| 3,864,876 | | 2/1975 | Diehn . | |
| 4,095,378 | | 6/1978 | Urakami . | |
| 5,090,162 | * | 2/1992 | Nelson | 451/92 |
| 5,257,479 | * | 11/1993 | Swain | 451/92 |
| 5,291,697 | * | 3/1994 | Nelson | 451/92 |
| 5,441,443 | * | 8/1995 | Roberts | 451/91 |
| 5,498,197 | * | 3/1996 | Roberts et al. | 451/94 |
| 5,688,162 | * | 11/1997 | Williams | 451/92 |

FOREIGN PATENT DOCUMENTS

| | | |
|---|---|---|
| 1966202 | 4/1972 | (DE) . |
| 9420172 | 3/1995 | (DE) . |
| 1195464 | 6/1970 | (GB) . |
| 403544 | 3/1974 | (SU) . |

* cited by examiner

*Primary Examiner*—Eileen P. Morgan
(74) *Attorney, Agent, or Firm*—Ladas & Parry

(57) ABSTRACT

In a blasting device, the blasting agent is thrown against the wall to be cleaned. The blasting agent and the dirt removed from the wall are collected in the bottom of the blasting unit in a collection chamber and conveyed by a conveyor to a separation chamber. An extraction device fitted on a suction connection creates air circulation in the blasting device, such that air circulation, the dirt and the blasting agent are separated. The air is supplied through an air supply opening which is placed between the inner seal and the outer seal around the blast opening.

8 Claims, 6 Drawing Sheets

BLASTING DEVICE FOR CLEANING A WALL

The invention relates to a blasting device for cleaning a wall according to the preamble of claim 1.

Such a device is known from EP-A-0,550,248. The blasting device described in this publication has the disadvantage that in the region of the blast opening there is insufficient air flow to prevent the dust occurring near the wall from leaking out along the seals between the blasting device and the wall. In the known device the air supply to the separation chamber is the main supply of air from outside the housing. The air supplied is largely used for air circulation in the separation chamber, and there is little air flow in the remainder of the housing and at the position of the seals. This means that the leakage of the dirt and dust removed from the wall is increased along the seals. Moreover, the blasting agent and dirt are separated only in the separation chamber, which is not ideal, and as a result the reused blasting agent will contains too much dirt. Consequently, additional dust can escape in the vicinity of the blast opening, which is undesirable.

The object of the device according to the invention is to make an improvement herein, and to this end the blasting device is provided with an air supply opening in the support plate through which during use the full air supply enters into the circulation chamber and continues into the closed housing through to a second opening, thereby creating high-speed air-circulation in the circulation chamber.

Placing the air supply between the inner and the outer seal ensures that a strong air stream occurs around the inner seal, which air stream entrains all dust leaking out between the inner seal and the wall. This means that no air and dust leak to the outside, and no pollution of the environment occurs.

A comparable device is known from U.S. Pat. No. 3,900,968, in which the material coming out of the blast opening is cleaned in a separation chamber situated below the blast opening, immediately after the material falls down from the blast opening. Owing to the fact that in this case the separation has to occur over a short distance, the separation is inadequate unless the extraction rate is greatly increased. However, this is not possible because in that case the blasting agent would be sucked up by the extraction device.

A device similar to U.S. Pat. No. 3,900,968 is described in DE-A-19 66 202. In this device the main air supply is through opening 42, which is placed under the seals. The air supplied is mainly used for separation of blasting agent and dirt in the collection chamber which is situated below the blast opening. Here the separation between dust and blasting agent occurs over a short distance, whereby insufficient cleaning of the blasting agent occurs, which gives rise to additional dust during blast cleaning. Openings 32 supply air between the seals for cooling and transport of blasting agent and dirt. However, as the main air supply is through opening 42 only limited air circulation enters through the openings 32. In DE-A-19 66 203 no indication is given that dust free blast cleaning is possible by guiding the full air supply in the circulation chamber and so creating a high-speed air-circulation and thereby preventing dust to escape outside the outer seal.

The invention is explained in greater detail in the following description of a number of exemplary embodiments with reference to the figures.

In the figures corresponding parts are provided with identical numbering as far as possible.

Figure 1:
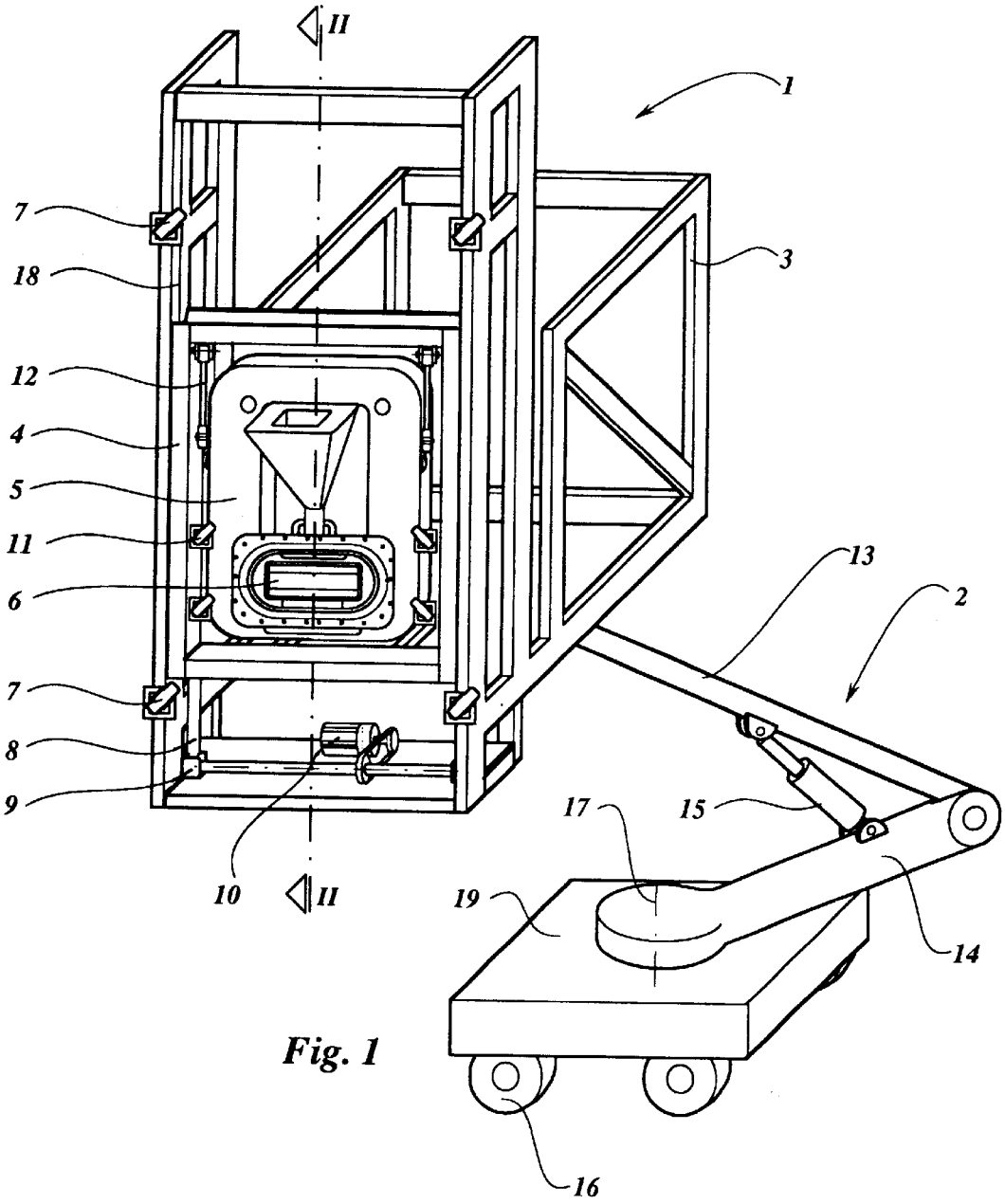
FIG. 1 shows a diagrammatic perspective view of a blasting device according to the invention, placed on a mechanical manipulator.

FIG. 1 shows a blasting device 1, which is placed on a mechanical manipulator 2. The blasting device 1 comprises a platform 3 to which a first frame 4 is attached. A blasting unit 5 is suspended in this first frame 4, which blasting unit 5 is composed of a number of parts which will be explained below, and the purpose of which is to throw a granular blasting agent at the position of a blast opening 6 at high velocity against a wall placed in front of the blast opening 6.

The blasting unit 5 must be able to move at an adjustable distance along the wall, with wheels 11 resting against said wall. The blasting unit 5 is suspended by a suspension 12 in the first frame 4. Said first frame 4 is movable by means of a screw spindle 8 in the vertical direction in a second frame 18 placed on either side. The two screw spindles 8 are driven by way of a right-angled transmission 9 by a motor 10. The second frame 18 and the platform 3 connected thereto rest against the wall by means of wheels 7.

The platform 3 is fixed in a known manner on an upper arm 13 of the manipulator 2, which is hinged to a lower arm 14. The lower arm 14 is mounted rotatably about an axis 17 on a carriage 19 which can travel on wheels 16. The platform 3 can be moved in the vertical direction by means of an operating cylinder 15.

A control box (not shown) and an extraction device and other means which are necessary for the control of the device can be placed on the platform 3. The control box can be suitable for controlling the blasting device 1 and the manipulator 2. In this case an operator can stand on the platform 3. However, it is also conceivable for a remote control to be present, in which case the operator stands on the ground. This solution has the advantage that the manipulator 2 can be made lighter, or that the equipment placed on the platform 3 can be heavier.

Figure 2:
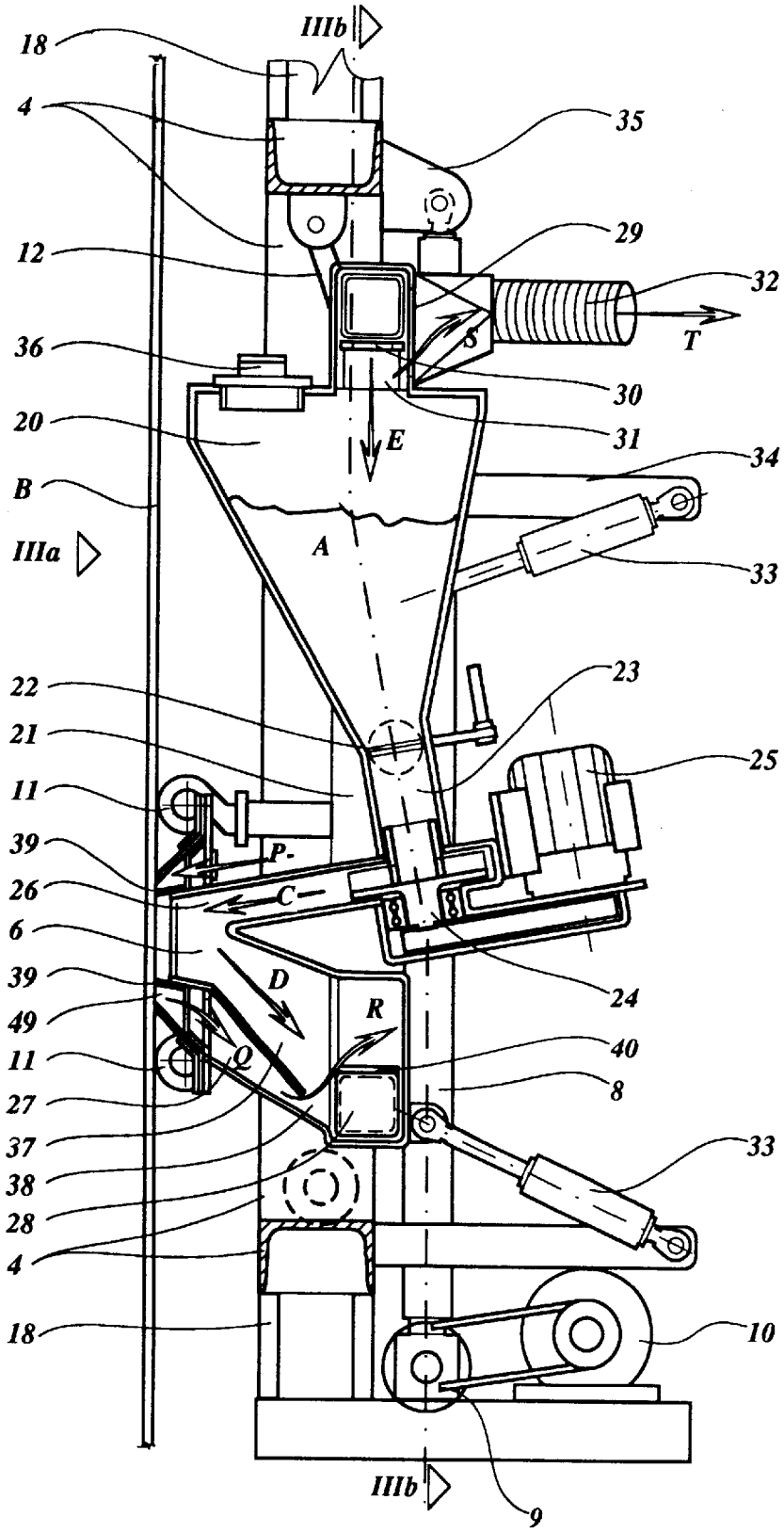
FIG. 2 shows a section on an enlarged scale of the blasting device of FIG. 1, along the line II—II.
Figure 3:
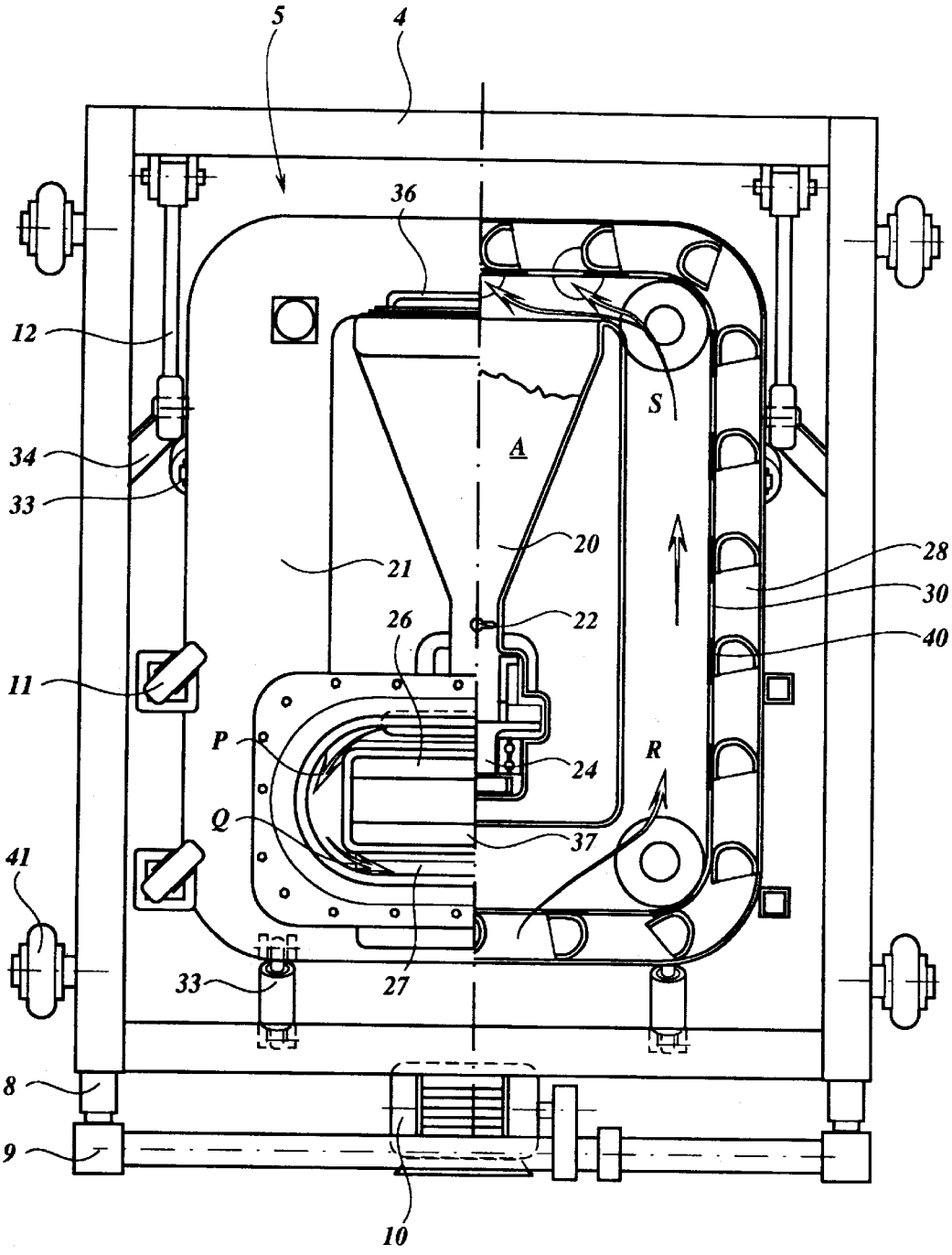
FIG. 3 shows a partial front view and a partial section of the blasting device of FIG. 2, in the direction of the arrow IIIa and along the line IIIb—IIIb, respectively.

FIGS. 2 and 3 show the blasting unit 5 suspended from the first frame 4 by means of the suspension 12. The blasting unit 5 comprises an essentially closed housing 21, part of which is formed by a buffer space 20. Blasting agent A is stored in the buffer space 20. The buffer space 20 is in communication with the central part of a throwing wheel 24 by means of a channel 23 in which a mechanically or manually operated valve 22 is placed. The throwing wheel 24 is driven rotatably by means of a motor 25, and throws the blasting agent in a blasting agent stream C through a throwing channel 26 to the blast opening 6 and against a wall B.

The mixture of blasting agent thrown against the wall B and rebounded and dirt D rebounds into a collection channel 37 and falls into a collection chamber 38. The dirt consists of the material removed from the wall B. Any material which leaks along an inner seal 39 fitted around the blast opening 6 flows through a leakage channel 27 likewise to the collection chamber 38. A conveyor 28 conveys the mixture D out of the collection chamber 38, situated low down, to the top side of the housing 21 (see FIG. 3 in particular).

The conveyor 28 consists of an endless belt 40 which describes a rectangular path, the horizontal parts of the belt running through the collection chamber 38 and a separation chamber 31 respectively, and the vertical parts of the belt running on either side of the blast opening 6. Fixed on the endless belt 40 are containers or buckets which fill with material during movement of the belt through the collection chamber 38. Holes 30 are disposed between the containers in the endless belt 40, through which holes mixture E can fall down through the separation chamber 31 into the buffer space 20 when the endless belt 40 is situated below the containers.

One or more extraction openings 29 are provided in the housing 21, at the position of the separation chamber 31, which extraction openings are connected to an extraction hose 32 through a coupling piece. An extraction device (not shown), which causes an air stream in the blasting unit 5, is attached to said extraction hose 32. A supply air stream P in the region of the blast opening 6 causes an air stream Q around the inner seal 39 and through the leakage channel 27, and an air stream R along the conveyor to the top side of the housing. Owing to the high speed of the air stream, said air stream entrains the lighter particles, and consequently separates the heavier blasting agent from the lighter dirt. The air stream crosses the stream of material at two points, namely in the bottom of the housing near the collection chamber 38 and in the top of the housing in the separation chamber 31. This makes double cleaning of the blasting agent possible.

In the top side of the housing 21 a stream S of the extracted air with dirt passes through the extraction opening 29 and the extraction hose 32 to the extraction device causing an air stream T, where the dirt is filtered out of the air in a known manner.

Owing to the fact that the air stream Q, which is equal to the air stream T at the position of the extraction device, is travelling at high speed at the inner seal 39, and at that point causes vacuum relative to the environment, partly due to said high speed, all dirt leaking out between the inner seal 39 and the wall B is extracted with the rest, and no undesirable leakage of dirt removed from the wall occurs. During the entire journey from the blasting of the wall B up to the separation chamber 31, the air stream flows at high speed along the material and, owing to the difference in mass and the difference in the speed of conveyance of the material and the air speed, the air stream entrains all dust present in the material to the extraction device.

The blasting unit 5 is suspended by the suspension 12 from the frame 4, the wheels 11 attached to the housing 21 resting against the wall B. Said wheels 11 are pressed with a constant force, for example approximately 100 N, against the wall B. The pressure force is caused by a number of gas springs 33, which are also attached to the frame 4 by means of a support 34. Owing to the use of the gas springs 33, said pressure force is independent of the exact position of the blasting unit 5 relative to the frame 4, as a result of which the quality of the blasting is improved.

Supports 35, to which the screw spindles 8 are attached, are attached to the frame 4. Said screw spindles 8 can move the frame 4 at an accurately controllable and constant speed of, for example, 0.5 m/min along the guide 18, and consequently along the wall B. The quality of the blasting operation is largely dependent on the constancy of said speed.

The capacity of the extraction device is 3000 to 4000 $m^3/h$, with the result that an air speed of approximately 80 m/sec occurs in the extraction hose 32.

It can be seen in FIG. 3 how the conveyor 28 is accommodated in the housing 21, and how the supply air stream P flows along the conveyor 28 through the housing 21. The endless belt 40 of the conveyor 28 is driven in a clockwise direction by a motor (not shown). Guide rollers 41, by means of which the frame 4 can move in the guide 18 (see FIG. 2), are also shown.

Figure 4:
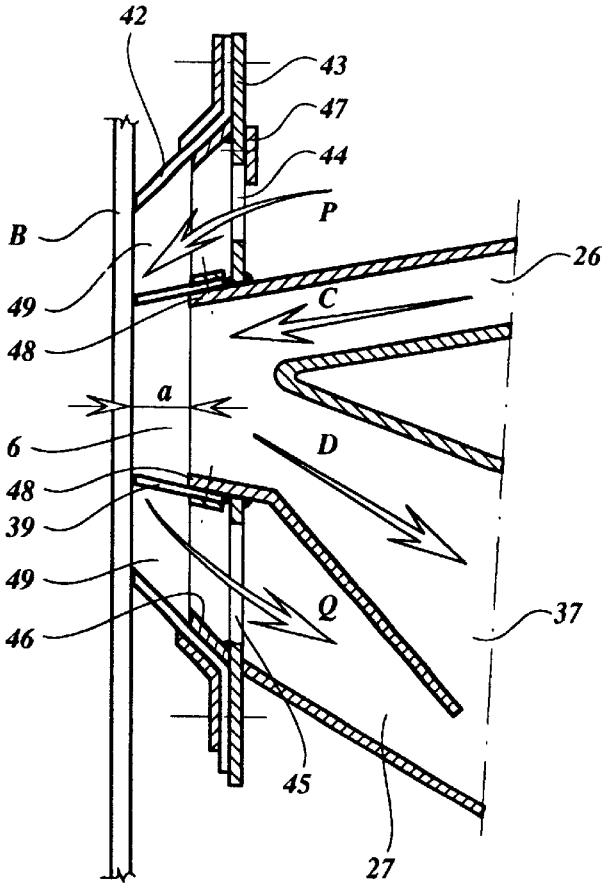
FIG. 4 shows on an enlarged scale the area around the blast opening of the blasting device of FIG. 2.

FIG. 4 shows how the blasting agent stream C is thrown out of the throwing channel 26 at the position of the blast opening 6 against the wall B, and how the mixture of blasting agent and dirt D rebounds into the collection channel 37. The throwing channel 26 and the collection channel 37 merge in a channel mouth 48, and the flexible inner seal 39 is fitted between the channel mouth 48 and the wall B. Said inner seal 39 consists of flat pieces of rubber which are fixed by means of strips against the channel mouth 48. The channel mouth 48 is made of steel and is situated at a distance a from the wall B to be sand-blasted. The distance a is adjustable by positioning of the wheels 11 (see FIG. 2). Hard dirt can be present on the wall B to be cleaned by blasting and, in order to prevent the channel mouth 48 from being damaged by it, the distance a is approximately 10 mm.

A supporting plate 43, on which a supporting flange 46 is fixed, is fitted around the channel mouth 48. A circumferential outer seal 42 is fixed against the supporting flange 46. The outer seal is a rubber section formed in one piece, pressing against the wall B to form a seal. If, under the influence of the blasting, blasting agent or dirt leaks between the inner seal 39 and the wall, the outer seal 42 prevents it from spreading further to the outside air. Moreover, further spreading is prevented by the fact that vacuum and a strong air stream generated by the extraction device are present in a circulation chamber 49, formed by the inner seal 39, the wall B, the outer seal 42 and the supporting plate 43, with the result that all dirt is entrained by the air stream Q to the leakage channel 27.

The circulation chamber 49 is in communication with the outside air by way of an air supply opening 44, and with the leakage channel 27 by way of an opening 45, which is suitable for allowing through the air stream Q and for discharge of the dirt present in the circulation chamber 49 to the leakage channel 27. The air supply opening 44 is provided with an adjustable valve 47, by means of which the air stream through the blasting unit 5 can be adjusted and adapted to the specific circumstances. The adjustment of the valve 47 also determines, inter alia, the air speed at the position of the separation chamber, and consequently also ensures that the blasting agent and dirt are separated properly, so that no blasting agent is sucked into the extraction device.

Figure 5:
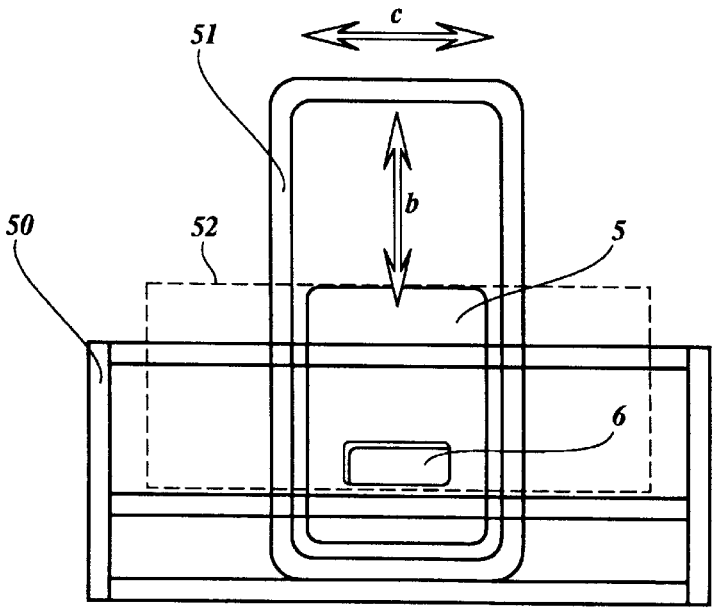
FIG. 5 shows diagrammatically the working area of the blasting device of FIG. 1, the movement mechanism of which has been adapted.

FIG. 5 shows how in a modified embodiment the movement of the blast opening 6 along the wall B can be achieved. The blasting unit 5 can make a vertical movement b, owing to the fact that it can move in a frame 51 with vertical guide. Said frame 51 can make a horizontal movement c in a frame 50 with horizontal guide. Said frame 50 is mounted on a manipulator in a comparable manner to that of the platform 3 discussed above. This means that in a particular position of the manipulator on which the frame 50 is placed the blast opening 6 can be moved over a working range 52. It is consequently possible to move the blasting unit 5 with the manipulator, the positioning of which can be rough with jolting movements, in front of a part of the wall B to be treated, and this positioning need not be accurate.

Thereafter, the blasting unit 5 can be moved accurately in front of the area to be treated, and during the blasting the movement along the wall can be accurate and free from jolts, which has a positive effect on the quality of the blasting.

In view of the greater weight of the frame 50 compared with the platform 3 described earlier (see FIG. 1) and the limited bearing capacity of the manipulator, the embodiment described here is generally combined with remote control of the blasting unit 5 and the horizontal and vertical movement, because the weight of the operator is then not being borne by the manipulator 2.

Figure 6:
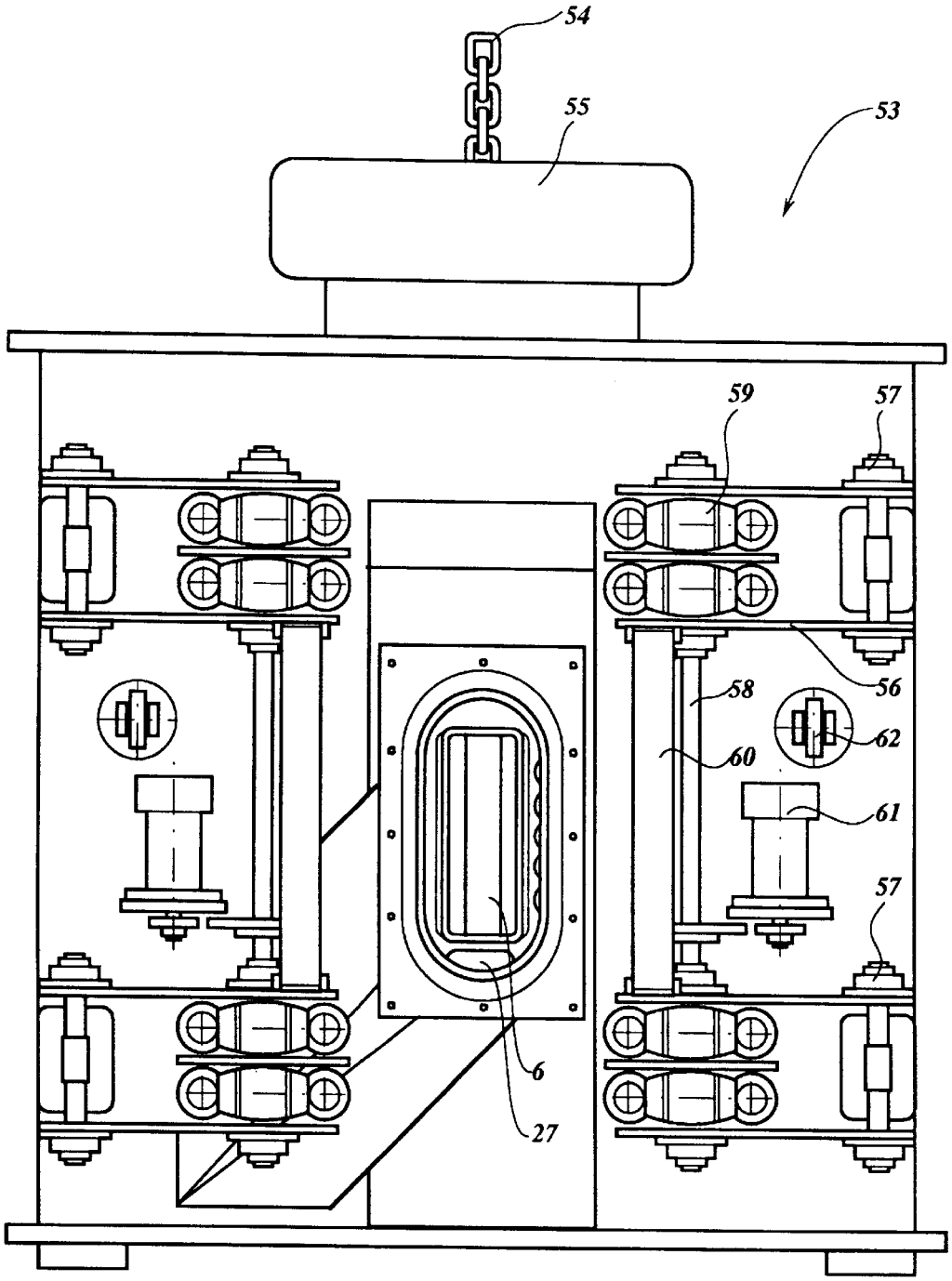
FIG. 6 shows a diagrammatic front view of a blasting device which is suspended in front of a wall.
Figure 7:
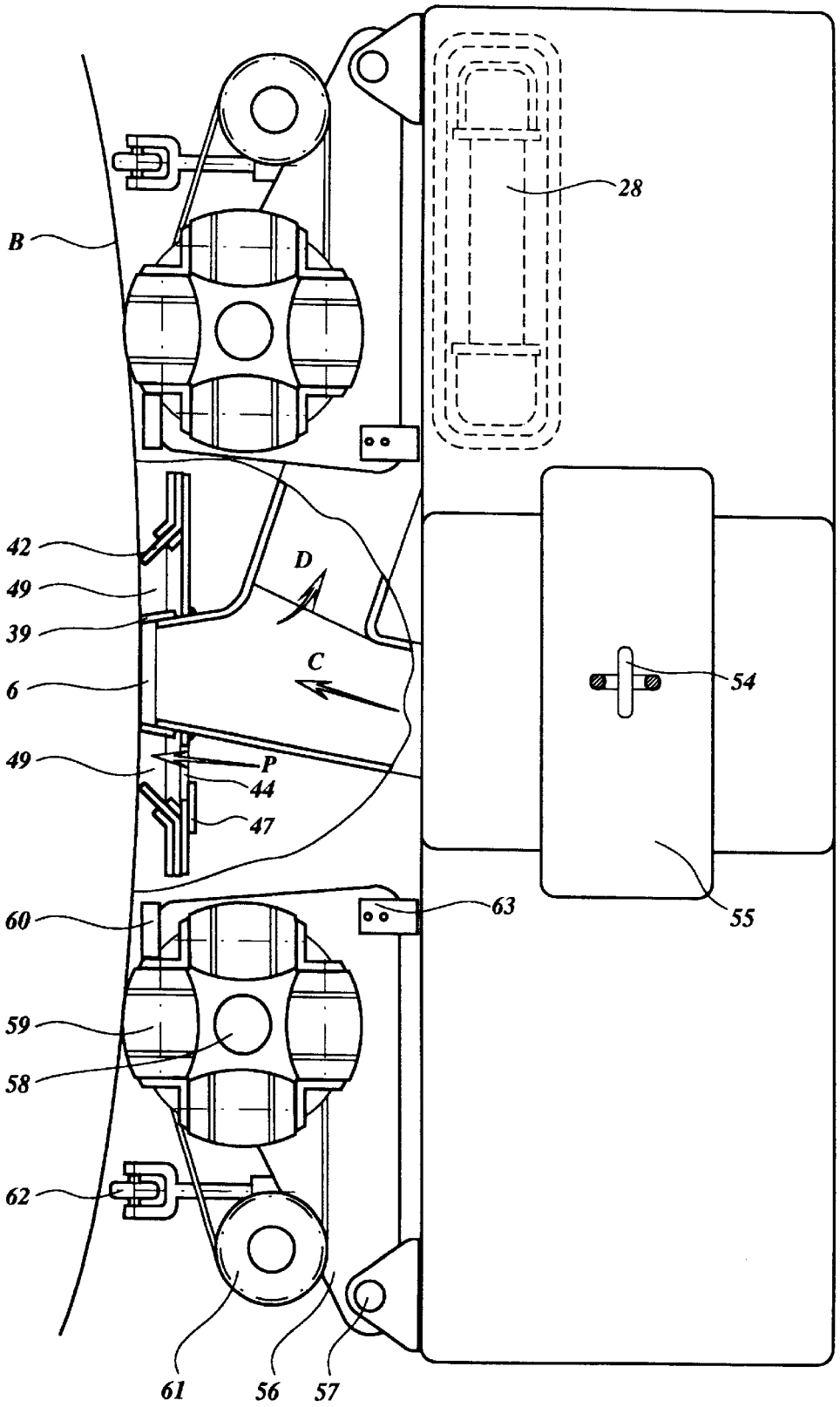
FIG. 7 shows a top view, partially in section, of the blasting device of FIG. 6.

FIGS. 6 and 7 show a blasting unit 53 which is suspended from a chain 54, and which can be moved by a hoisting device 55 in the vertical direction along the wall B to be blasted. The blasting unit 53 rests with rollers 59 against the wall B, which rollers 59 can rotate about their own shaft and about a shaft 58 positioned at right angles thereto. The shaft 58 can be driven rotatably by a motor 61 and is mounted in a swivel frame 56. Said swivelling frame 56 can be swivelled about a swivelling shaft 57 and placed by means of a clamp 63 in a certain position relative to the blast opening 6. Said clamp 63 is used to place the rollers 59 in such a way relative to the blast opening 6 that even walls which are not straight, for example the inside or outside of a round steel storage tank, can be cleaned without dust being caused.

The blasting unit 53 and the rollers 59 are pulled by magnets 60 towards the wall B to be blasted, the magnets and rollers being positioned relative to each other in such a way that a gap of approximately 10 mm remains between the wall B and the magnets 60. Owing to the attraction of the magnets 60, the rollers 59 acquire sufficient friction against the wall B, and the blasting unit 53 can be moved in the horizontal direction along the wall. Since the rollers 59 can also rotate about their own axis, the blasting device can also be moved along the wall in the vertical direction. After the blasting has been completed, the magnets 60 are pressed off the wall by means of a press-off roller 62.

The blasting unit 53 is provided with a blast opening 6, while the leakage channel 27 is provided on the underside. The air supply P to the circulation chamber 49 between the inner seal 39 and the outer seal 42 flows by way of said leakage channel 27 to the conveyor 28. Flow guide means (not shown) may be provided in the circulation space 49, in order to ensure that there is sufficient air flow around the seals, so that any dust leakage to the outside air is prevented.

What is claimed is:

1. Blasting device for cleaning a wall, comprising an essentially closed housing provided with a blast opening surrounded by an inner seal and an outer seal mounted on a support plate, the inner seal and the outer seal being adapted to be placed against the wall thereby forming a circulation chamber between the support plate, the wall, the inner seal and the outer seal, and further comprising throwing means inside the housing for throwing at the position of the blast opening a blasting agent through a throwing channel at high velocity against the wall to be cleaned, a discharge channel which runs from the blast opening down towards a collection chamber in which the material coming out of the blast opening and containing the blasting agent and the dirt removed from the wall is collected, a conveyer for conveying the material from the collection chamber to a separation chamber, said material returning to the throwing means by way of the separation chamber being provided with a suction connection connectable to an extraction device for creating an air flow from an air supply opening being provided in the support plate via the circulation chamber, a second opening in the support plate, the housing and the separation chamber to the suction connection, thereby creating an airflow in the circulation chamber which equals he airflow to the extraction device.

2. Blasting device as claimed in claim 1, wherein the air supply opening is provided with an adjustable valve.

3. Blasting device as claimed in claim 1, wherein the second opening is disposed on a bottom side of the blast opening during use against a vertical wall and is connected with a leakage channel for guiding the air flow and spillage from the inner seal towards the collection chamber.

4. Blasting device as claimed in claim 1, wherein the conveyor comprises an endless belt with conveyor buckets, the endless belt following a rectangular path with horizontal and vertical sections, the horizontal sections passing through the collection chamber and the separation chamber respectively, and the vertical sections passing on either side of the blast opening.

5. Blasting device as claimed in claim 4, wherein the endless belt is provided with openings for creating in the separation chamber a flow channel from the conveyor buckets to the throwing means.

6. Blasting device as claimed in claim 1, further comprising a first frame movably supporting said housing in directions at right angles to the wall, a second frame movably supporting said first frame in directions parallel to the wall said second frame being mounted on a position device.

7. Blasting device as claimed in claim 6, wherein the housing and the second frame are provided with swiveling wheels by means of which they can rest against the wall.

8. Blasting device as claimed in claim 1, provided with guide means and pressure means for positioning the blasting device relative to the wall, said guide means being adjustable relative to the blast opening in the direction at right angles to the wall.

* * * * *